United States Patent [19]

Price

[11] 4,343,571

[45] Aug. 10, 1982

[54] REINFORCED EARTH STRUCTURES

[75] Inventor: Derrick I. Price, London, England

[73] Assignee: Soil Structures International Limited, London, England

[21] Appl. No.: 56,916

[22] Filed: Jul. 12, 1979

[30] Foreign Application Priority Data

Jul. 13, 1978 [GB] United Kingdom ..... 29712/78

[51] Int. Cl.[3] ..... E02D 29/02

[52] U.S. Cl. ..... 405/284

[58] Field of Search ..... 405/262, 272, 284, 286

[56] References Cited

U.S. PATENT DOCUMENTS

| | | | |
|---|---|---|---|
| 635,068 | 10/1899 | Windett | 405/286 |
| 3,421,326 | 1/1969 | Vidal | 405/284 |
| 4,116,010 | 9/1978 | Vidal | 405/262 |

FOREIGN PATENT DOCUMENTS

| | | | |
|---|---|---|---|
| 1000514 | 2/1952 | France | 405/284 |
| 2315572 | 1/1977 | France | 405/286 |
| 1323452 | 7/1973 | United Kingdom | 405/284 |
| 1324686 | 7/1973 | United Kingdom . | |
| 1485004 | 9/1977 | United Kingdom | 405/284 |

*Primary Examiner*—David H. Corbin

*Attorney, Agent, or Firm*—Scrivener, Clarke, Scrivener and Johnson

[57] ABSTRACT

A reinforced earth structure comprises a mass of particulate material and stabilizing members, the members being arranged in vertically spaced layers separated by layers of particulate material. The stabilizing members are made of flexible material which is relatively unresilient and each layer of stabilizing members is tensioned while the succeeding layer of particulate material is laid thereon.

20 Claims, 15 Drawing Figures

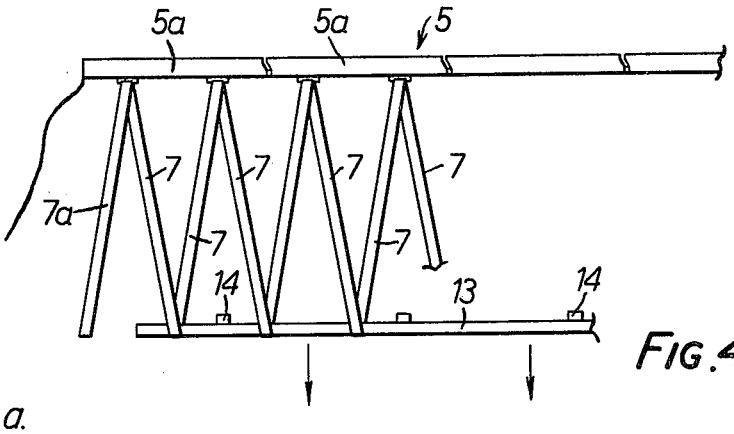
FIG. 4.
FIG. 4a.
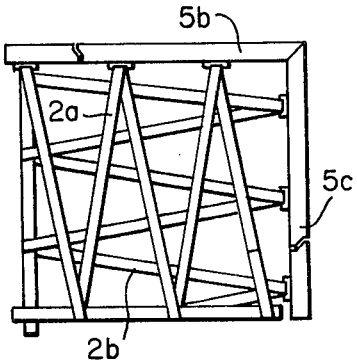
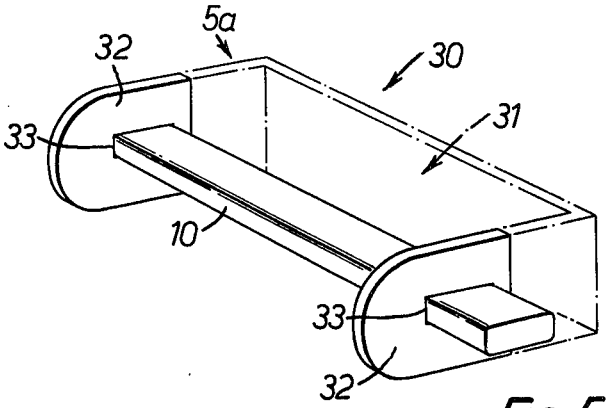
FIG. 5.
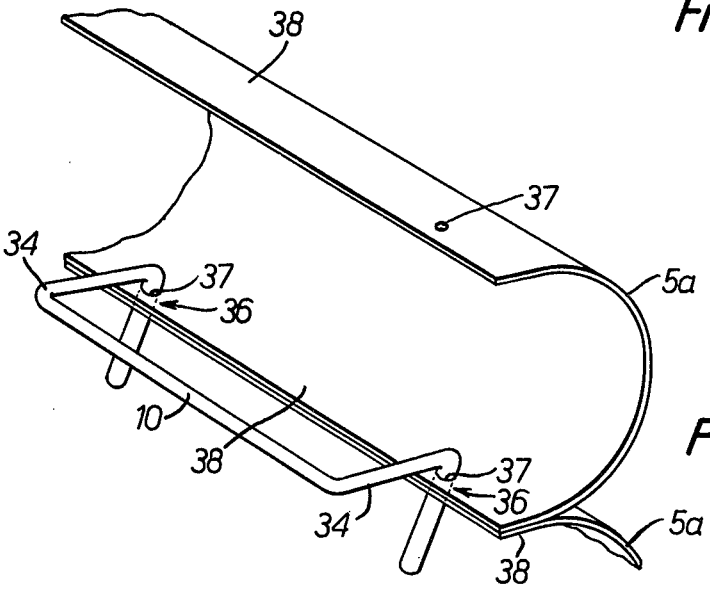
FIG. 6.

REINFORCED EARTH STRUCTURES

The present invention is concerned with improvements in the reinforcement or stabilisation of structures comprising a mass of particulate material, known as reinforced earth structures.

Examples of such structures are described inter alia in British patent specification Nos. 1069361 and 1324686 and comprise a mass of particulate material which is stabilised by the inclusion therein of vertically spaced layers of elongate stabilising members, which give the mass a degree of stability in tension, in addition to the natural stability of the mass in compression, the degree of stability depending on the type and arrangement in the mass of the stabilising members and the type of the particulate material.

The structure may for example form an abutment, a revetment, an embankment, a dam, a dyke, a tunnel, a bridge, a foundation slab, a breakwater, a quay, a harbour wall or a column, and the particulate material may be stones, gravel, sand, soil, ashes, slag, colliery shale, rock, silt, clay, pulverised fly ash, or the like. Optimally the material is non-cohesive and has particles of not greater than 350 mm in diameter with not less than 75% smaller than 150 mm and less than 25% smaller than 75 microns. Where the structure has an exposed lateral surface, that surface may be provided with a facing to prevent errosion and to provide the structure with an aesthetically pleasing appearance.

Reinforced earth structures as described above have been constructed successfully. However in these structures stabilising members are made of highly resilient flexible material, specifically strips of sheet metal. The sheet metal strips are brought to the site already cut to the required length and are then laid in the structure in layers each strip being connected, e.g. bolted, to the facing where provided.

According to one aspect of the present invention there is provided a structure comprising a mass of particulate material and stabilising members, the members being arranged in vertically spaced layers separated by layers of the particulate material, wherein the members are made of flexible material which is relatively unresilient, and at least some of the members are integrally connected together.

According to another aspect of the present invention there is provided a method of constructing a structure, using a mass of particulate material and elongate stabilising members, the method comprising arranging a plurality of stablising members in a layer on a layer of particulate material, laying a second layer of particulate material over the layer of stabilising members, and repeating the layers of stabilising members and particulate material until a structure of the required height is achieved, wherein the stabilising members are made of flexible material which is relatively unresilient, and at least some of the members are integrally connected together.

The members in each layer may extend in zig-zag manner or generally parallel to one another between opposite sides of the structure. The members of a respective layer may comprise at least two sets of members, each set of members extending between pairs of opposite sides of the structure, which pairs are relatively inclined to each other.

The structure may also comprise a layer of sheet material extending substantially continuously across the structure and associated with each layer of stabilising members, the sheet material preferably being arranged between a layer of stabilising members and the succeeding layer of particulate material.

The or some of the members of each layer may be integrally connected together and provided by a single continuous length. Preferably these members are integrally connected together in at least threes. Althernatively, the or some of the members in one layer may be integrally connected to respective members in an adjacent layer. The members in the layers may be vertically aligned with vertically aligned members being integrally connected together and provided by a single continuous length of material.

Where the structure includes a lateral surface, the surface may be provided with a facing and the or some of the members may be connected to the facing and extend therefrom inwardly of the structure. The connection between the members and the facing may be made by means of elements connected to the facing which extends through loops formed between integrally connected members. The elements may be releasably connected to the facing. The facing may comprise a plurality of facing members which may be assembled together so as to permit limited relative vertical movement between them and each facing member may be connected to at least one stabilising member in each of two adjacent layers of stabilising members.

Alternatively, where the structure includes a lateral surface, that surface may be provided with a facing which is not connected to the stabilising members but is either self sustaining or otherwise anchored in the structure.

It will be appreciated that the degree of flexibility which the material of the stabilising members may have must be such as to permit the material to fold through at least 90° without undue application of force thereto. The members may, for example, be in the form of string, cord, rope, wire, cables, multi-strand cord, string or wire, strips of sheet material or woven fabrics, strips of wire mesh, material in webbing form or chains and may be made of any suitable material. The material used must be capable of withstanding the tensions which will be imposed on it by the structure and must have a life in the environment of the structure in excess of that of the structure. For example for a permanent structure the material must be substantially not degradable whereas for a temporary structure degradable materials may be used. The presently preferred materials for permanent structures are plastics, specifically polymers. A webbing sold by ICI under the trade name PARAWEB (trade mark), and comprising high tenacity synthetic fibres of polyester encased in a protective polyethylene sheath, has been found to be particularly suitable for use as a stabilsing member.

In building a structure using such flexible but relatively unresilient stabilising members, the members of one layer are laid on the preceding layer of particulate material which has generally, but not necessarily, been compacted and, because of the relative unresilience of the stabilising members, the members will tend to follow the contour of the surface of the particulate material layer which will not be entirely flat. Thus the actual length of the member will be greater than its jorizontal extent. During the subsequent construction and after construction, the members will tend to straighten out under the tensions in the structure producing a certain amount of uncontrolled movement of the structure.

This movement, while in general not endangering the structure, can provide unsightly effects, e.g. bulging of facings.

According to another aspect of the present invention there is provided a method of constructing a structure comprising a mass of particulate material and elongate stabilising members, the method comprising arranging a plurality of stabilising members in a layer on a layer of particulate material, laying a second layer of particulate material over the layer of stabilising members, and repeating the layers of stabilising members and particulate material until a structure of the required height is achieved, wherein the stabilising members of each layer are tensioned while the succeeding layer of particulate material is being laid.

Where the structure includes a facing on a lateral surface and the members of each layer are connected to the facing by their one ends, it is merely necessary to subject the other ends of the members to a pull to tension the members. Tension on the members is maintained at least until they are covered by part of the succeeding layer of particulate material. Tension on the stabilising members may be maintained permanently or may released once the part of the succeeding layer of particulate material has been laid on. Where tension is maintained, the other ends of the stabilising members may be pegged or otherwise fixed relative to the underlying structure.

Where the stabilising members of a layer are integrally connected together so as to provide loops between adjacent ends thereof, the loops at one side of the structure may be held relative to the structure and the loops at the other side of the structure may be engaged by tensioning means on which the pull is exerted. The tensioning means may be releasably engageable with the stabilising members or may be permanently engaged therewith. The tensioning means may for example be a rod which is engaged in the loops or bears hooks which are releasably engaged with the loops.

The invention will by more fully understood from the following description of embodiments thereof, given by way of example only, with reference to the accompanying drawings.

In the drawings:

FIG. 4 is a diagrammatic plan view of the structure of FIG. 1 during construction;

Figure 1:
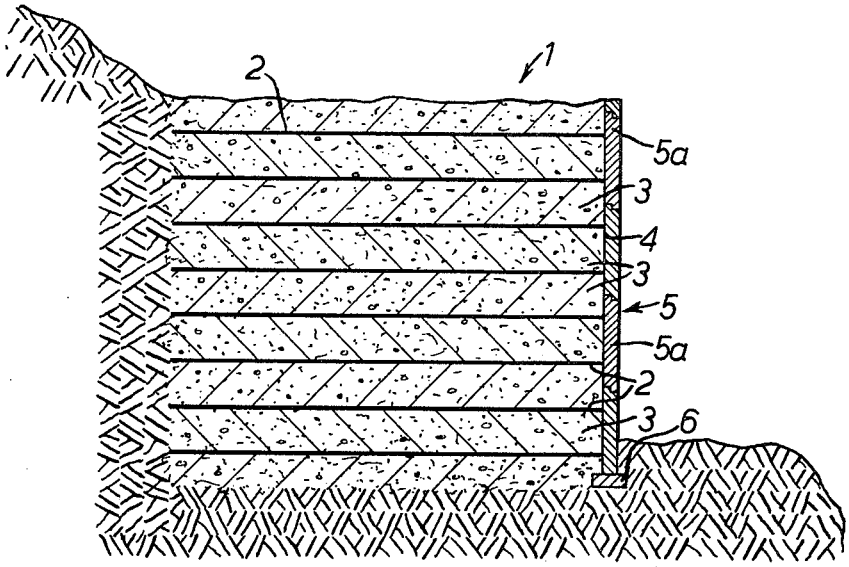
FIG. 1 is a diagrammatic sectional view through an embodiment of a structure according to the present invention.
Figure 7:
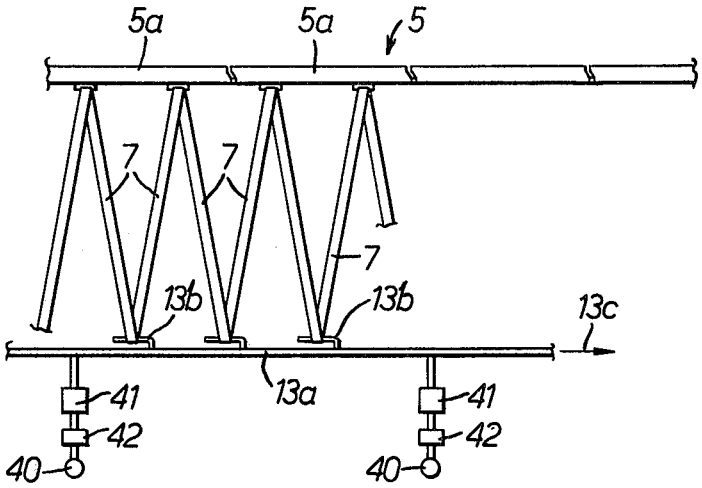
Figure 8:
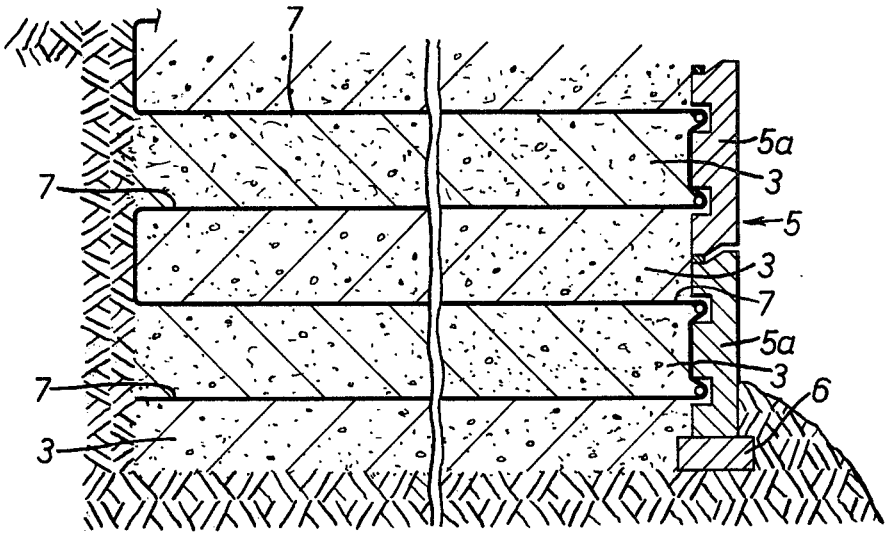
Figure 9:
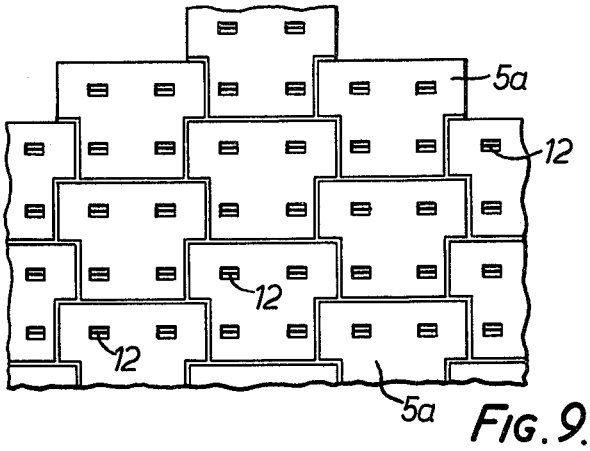
Figure 10:
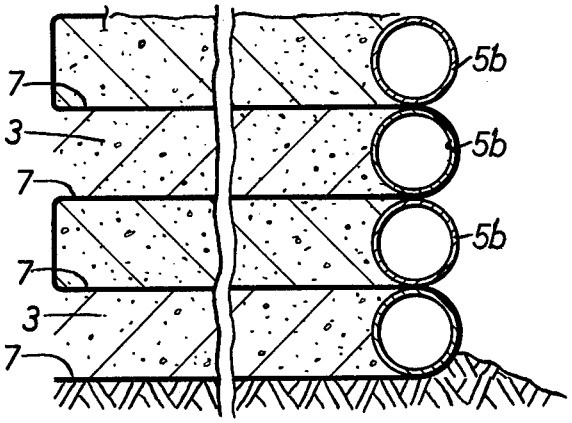
Figure 11:
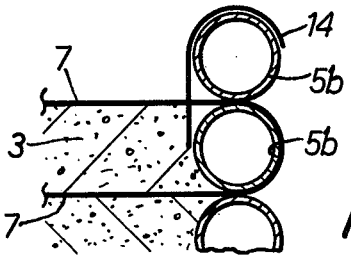
Figure 12:
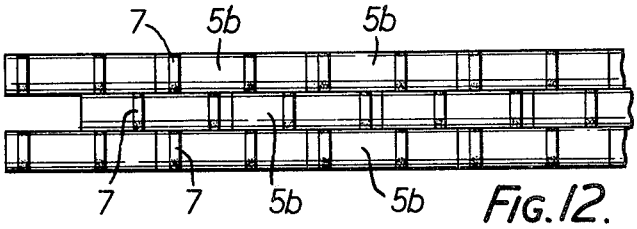
Figure 13:
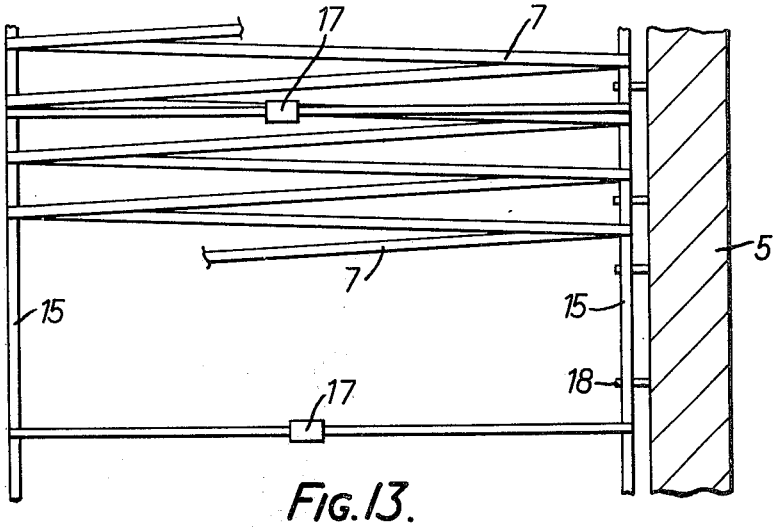
Figure 14:
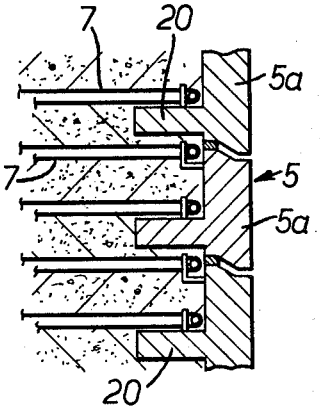

FIG. 4*a* is a diagrammatic view similar to FIG. 4 showing two sets of stabilitzing members disposed between two lateral surfaces of a structure;

FIGS. 5 and 6 are perspective views showing other embodiments of connections between a stabilising member and the facing;

FIG. 7 is a diagrammatic plan view showing a tensioning arrangement for tensioning the stabilising members of a layer;

FIG. 8 is a diagrammatic vertical section through another embodiment of structure according to the present invention;

FIG. 9 is an elevation showing the inner surface of one form of facing for use in either of the embodiments of FIGS. 1 and 8;

FIG. 10 is a vertical section through a structure similar to that shown in FIG. 8 but with another form of facing;

FIG. 11 is a vertical section through the structure of FIG. 10 and showing a detail thereof;

FIG. 12 is an elevation of the outer surface of the facing of the structure of FIG. 10;

FIG. 13 is a plan view of a layer of stabilising members assembled for use in the construction of a submerged or partially submerged structure;

FIG. 14 is a vertical section through a submerged structure; and

Figure 15:
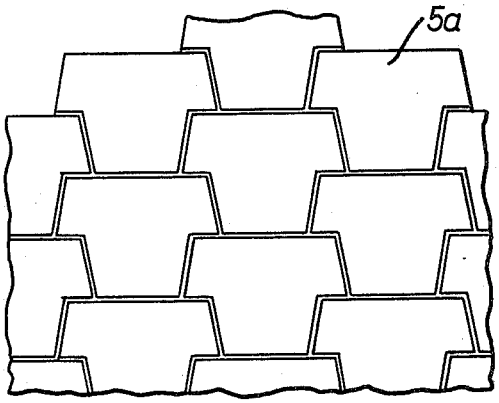

FIG. 15 is an elevation of the facing of the structure of FIG. 14.

FIG. 1 shows a structure 1 including a mass of particulate material and stabilising members, the members being arranged in layers 2 between layers 3 of the particulate material. As shown, the structure has a lateral vertically extending surface 4 which is provided with a facing 5 to which the stabilising members of the layers 2 are connected, the members extending therefrom inwardly of the structure to a depth which depends on the structure.

The structure 1 is constructed by first excavating the region of the structure, where necessary. A channel is then excavated at the front of the structure and a strip foundation 6, e.g. of concrete, is cast in the channel. The facing 5 comprises a plurality of facing members which are arranged in rows so that the facing 5 is built up at the same time as the layers of particulate material and stabilising members 3, 2. The first layer of facing members 5*a* is arranged on the foundation strip 6 and the ground behind the facing 5 is built up to the required level of the first layer of stabilising members. This layer of particulate material is preferably compacted and then the stabilising members are laid thereon and are connected to the facing members. Thereafter a layer of particulate material is arranged over the layer 2 and preferably compacted and the next layer of stabilising members is arranged thereon. The layering of particulate material and stabilising members continues at the same time as the layering of facing members until the structure has reached the required height.

The stabilising members are made of any suitable natural or synthetic material and are flexible but relatively unresilient, as compared with strip metal, and may be in the form of string, cord, rope, wire, cable multi-strand cord, string of wire, chain, webbing strips of sheet material, woven fabric or wire mesh or the like. In the particular embodiment which is shown in more detail in FIGS. 2 to 4, the reinforcing elements are in the form of a synthetic webbing which is preferably made of a synthetic polymer which may be a polyester. Advantageously the webbing is PARAWEB (trade mark) manufactured by ICI.

Figure 2:
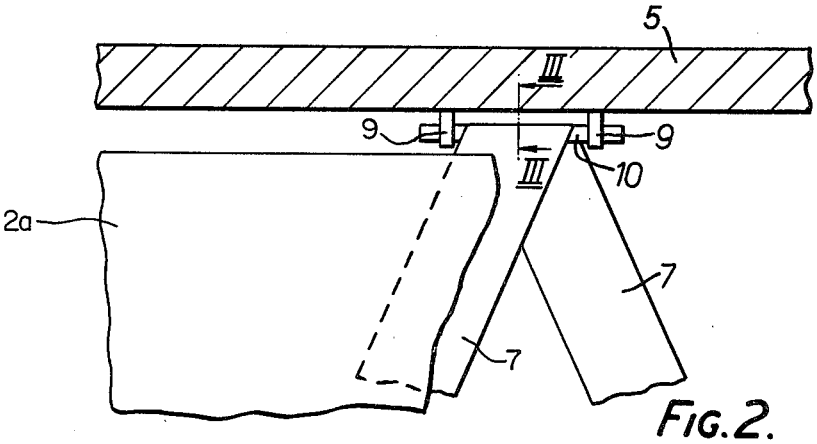
FIG. 2 is a horizontal section through the structure of FIG. 1 and showing an embodiment of a connection between a stabilising member and a facing of the structure of FIG. 1.
Figure 3:
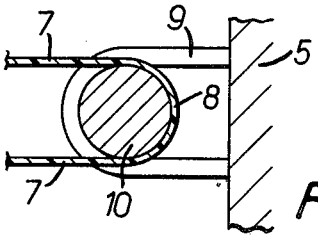
FIG. 3 is a section on the lines III—III of FIG. 2 to an enlarged scale.

As shown in FIGS. 2 to 4, the stabilising members 7 in each layer are integral and are provided by a single length of webbing which is laid over the preceding layer of particulate material in zig-zag fashion between the front of the structure which is provided with the facing 5 and the rear of the structure. At the front of the structure the ends of the elements 7 are integrally connected by loops 8 which are used to connect the elements to the facing 5. As shown in FIG. 2, the facing members 5*a* are provided with pairs of U-shaped elements or staples 9. To connect the ends of two members 7 to the facing member, a bar 10 is inserted through one staple 9, the loop 8 between the members 7, and the other staple 9. Alternatively the members 5*a* may be recessed and the bars 10 housed in the recesses, the bars either being fixed in place or removable from the recesses.

In a modification the pairs of staples 9 may be replaced by U-shaped brackets 30, FIG. 5, each of which is arranged with its base 31 embedded in or otherwise fixed to the facing member 5*a* and with its arms 32 projecting from the facing member. The arms 32 are provided with apertures 33 to receive the bar 10. The bracket 30 may be made of a non-metallic material, e.g. a reinforced plastics material, and the bar 10 may also be made of a reinforced plastics material. To increase the strength of the bar 10, it may have, as shown, a rectangular, or an I, section and is arranged with the long side of the rectangle, or upright of the I, horizontal, the apertures 33 in the arms 32 of the bracket 30 being correspondingly shaped to hold the bar 10 in this position. In a further modification shown in FIG. 6, the bar 10 is formed by the base of a U-shaped member having arms 34 the ends of which are bent back to form hooks 36 which are engaged in openings 37 provided in a flange 38 formed on the facing panel 5*a*. This arrangement is conveniently used where the panel 5*a* is moulded plastics material so that the flange 38 and opening 37 can be integrally moulded with the panel.

With a structure which, while including a lateral face, is not provided with a facing 5, or not provided with a facing to which the elements are connected, or does not include a lateral surface, the ends of the members 7 merely lie along opposite edges of the structure.

In a structure having two or more lateral surfaces, such as surfaces 5*b* and 5*c* as shown in FIG. 4*a* which may be inclined to each other, each layer 2 of stabilising members may include two or more sets of stabilising members, such as 2*a* and 2*b*, each set extending from a respective lateral surface into the structure.

While as described above, the members 7 of any one layer 2 are made from a single length of web, it will be appreciated that they may be made from two or more such lengths with the members integrally connected together in threes or fours at least.

There is a particular advantage in making the stabilising members in any one layer from one continuous length of web, where that webbing is for example PARAWEB or has a degradable core with a protective sheath. The advantage is that in each layer there are only two ends of the material at which the core can be attacked and degraded so that, if this is taken into account, no steps may be taken to seal the ends of the web.

It may be found desirable to cover each layer of stabilising members with a sheet of material, e.g. of polyester or polypropylene, as shown, for example, at 2*a* in FIG. 2 to ensure that the members remain flat while the succeeding layer of particulate material is laid. Alternatively the stabilising members may be held flat by other means. For example U-shaped anchoring members may be used which are placed at intervals along the stabilising members, the anchoring members each having a base the width of a stabilising member and being arranged with the base extending across a stabilising member and the arms projecting into the ground beneath the stabilising member. These anchoring members may be made of metal or of a synthetic material such as plastics.

To ensure that there is minimal movement within the structure when completed, it is found necessary with relatively unresilient stabilising members to ensure that, when a layer of particulate material is laid over a layer of such stabilising members, the members are substantially planar and do not follow the contours of the surface of the preceding layer of particulate material. This is obtained by tensioning the stabilising members and maintaining them under tension at least while part of the succeeding layer of particulate material is laid on them. The weight of this succeeding layer of particulate material will force the preceding layer of stabilising members into contact with the underlying layer of particulate material, so that maximum frictional forces are developed between the layers, but because the stabilising members are under tension there will be minimum slippage under the tension developed in the structure.

With the arrangement of stabilising members in each layer 2 shown in FIG. 4, tensioning is particularly simply effected merely by threading a rod 13 through the loops formed between the members 7 at that end of the structure remote from the facing 5 and pulling on the rod 13. As an example a tension of 10 kg approx per member has been found sufficient. When a sufficient tension has been reached, the rod 13 can be fixed in position, for example by pegs 14 inserted in the underlying structure, the force on the rods being then removed. Before this is effected the members 7*a* at each side of the structure including the free ends are tensioned and pegged. Once the members 7 have been tensioned, the next layer of particulate material is laid on them and compacted.

In the above described tensioning arrangement, the rod 13 remains in the structure. Since the tension applied to the stabilising members can be removed once at least part of the succeeding layer of particulate material has been laid, for example to a depth of ½ meter, it is advantageous to use a tensioning arrangement which is releasable from the layer of stabilising members for re-use with the succeeding layer. Such an arrangement is illustrated in FIG. 7. As shown, the rod 13*a* is provided with hooks 13*b* which are engaged in the loops between the stabilising members. A pull is exerted on the rod 13*a* to tension the stabilising members and this pull is maintained while at least part of the succeeding layer of particulate material is laid down. The pull is then removed and the rod 13*a* disengaged from the loops by application of an axial force thereto in the direction of the arrow 13*c*. The pull on the rod 13*a* can be applied for example by connecting the rod at a plurality of points to a plurality of rearward anchorage points 40 by turnbuckles 41 or the like and tension indicators 42. In operation, when the rod 13*a* has been connected to the anchorage point 40, the turnbuckles are screwed up to tension the stabilising members to a pre-set tension which is indicated by the tension indicators.

It will be appreciated that, where the structure does not include a facing 5 to which the stabilising members are connected at one end, to tension the stabilising members either a pull must be exerted on both ends, for example by either of the arrangements described above, or one end of each stabilising member must be anchored and the other end connected to a tensioning arrangement.

In another embodiment of structure shown in FIG. 8, the stabilising members 7 are again arranged in layers. However in this embodiment the stabilising members 7 extend substantially perpendicularly from the facing 5 and are arranged in vertical rows, the members in each row being integrally connected together. The facing members 5*a* are provided with connecting bars 10 which may be set in recesses 12 as described in connection with the embodiment of FIGS. 1 to 7. To construct the structure shown in FIG. 8, after the foundation strip 6 and first layer of particulate material have been laid, the first layer of members 7 is arranged extending from the inner end of the structure to the first row of bars 10 in the lowest member 5*a*. The members 7 are engaged with the members 5*a* and tensioned. Thereafter a second layer 3 of particulate material is laid on the members 7 and compacted and the members 7 are then connected with the second row of bars and laid over the second layer of particulate material and tensioned. The third layer of particulate material is laid on the second layer of members 7 which are brought round the inner end of this layer to form the third layer of members 7. This layering of the members 7 on particulate material with engagement of the members 7 with the facing members 5*a* continues until the required height of the structure has been obtained.

In a modification of the foregoing arrangement, alternate ones of the members 7 in each layer may extend in opposite directions so that each layer of particulate material has parts of the members 7 extending round both the edge adjacent the facing and the inner edge.

In a structure which is not provided with a facing, or has no lateral surfaces, the material of the members 7 is merely folded round each succeeding layer of particulate material, as occurs at the lefthand side of FIG. 8.

While as described the members 7 in each vertical row of members are made from a single length of material, it will be appreciated that they may be made of two or more lengths, preferably at least two members 7 of adjacent layers being integrally connected together.

The facings 5 in the above described embodiments may be of any suitable form. As shown the facings are made of cast concrete or plastics blocks, for example as shown in FIG. 9. Alternatively the facing 5 may for example be made of wire mesh, plastics sheet, corrugated plastics, corrugated metal or other shaped elements of plastics material.

The facing members 5*a* shown in FIG. 9 are generally T-shaped and each has a width such that it is connected to at least two stabilising members (in the embodiment of FIG. 8) or two pairs of stabilising members (in the embodiment of FIG. 1) in two adjacent layers, so that the member is stably connected to the stabilising member. The facing members are provided with stepped vertical and horizontal edges (as shown in FIGS. 8 and 9) and seals are provided between the edges, the seals between the vertical edges being for example of cork, and the seals between the horizontal edges being resiliently compressible, e.g. or polyethylene foam, to permit a degree of relative vertical movement between the panels to allow for settlement of the structure in time. The panels are vertically interconnected by dowels (not shown).

An alternate facing is shown in FIGS. 10 to 12 in connection with the embodiment of FIG. 8, the facing being provided by semi-tubular or, as shown, tubular members 5*b* e.g. pipes of plastics material, around which alternate members 7 of alternate layers extend. During construction, the top layer of pipes 11*b* is held vertically, for example by means of hooks 14 shown in FIG. 5 which are engaged over the pipes of a layer of pipes and temporarily inserted into the underlying structure, the hooks 14 being removed as soon as the top layer of pipes is held in place by engagement thereabout of the members 7. FIG. 12 shows an arrangement of such pipes 5*b* with the members 7 extending around them.

Submerged or partially submerged structures can be constructed as described above using, if necessary, divers. However if a facing is provided on the structure, the facing must be heavy enough not to float and must be such as not to be capable of being pulled away from the structure by currents in the water. Additionally it is convenient to modify the above methods of construction to avoid the requirement for divers. For example in a construction of the type described with reference to FIGS. 1, 2 and 3, each layer may be assembled on the surface. For example as shown in FIG. 13, the members 7 may be arranged extending in zig-zag fashion between two rods 15 on the surface. The members 7 are then tensioned by connecting between the rods 15 at least two rods 16 provided with means 17, e.g. turn buckles, for lengthening the rods 16 and so tensioning the members 7. This array, assembled on the surface, is then lowered onto the first layer of particulate material, which under water will be hydraulic fill. A second layer of particulate material is then arranged over the array of members 7 and a second array is lowered onto the surface of that layer of particulate material. Each array of members 7 may be connected to the facing 5. For example hooks 18 may be provided extending from the facing members 5*a*, the rod 18 adjacent the facing 5 being lowered into engagement with the hooks.

If the structure extends above the level of the water, assembly of the layers of particulate material and stabilising members may proceed as described with reference to FIGS. 1 to 3.

If the structure is provided with a facing, it should optionally be self sustaining so that, again, it can be assembled from above the surface of the water. Additionally the members 5*a* should be adapted to nest, i.e. be self-positioning. For example the facing members may be diamond shaped, with the top and bottom row of members being triangular. To be self-sustaining, the members of the facing should have a substantial thickness, for example of between 20 to 90 cm, as compared with members for use above water of 12 cm thickness. Alternatively the members may, as shown in FIG. 15 be generally T-shaped, similar to the members shown in FIG. 9, but with the stem of the T tapered so that each member 5*a* is self-positioning. For the facing to be self-sustaining, the members 5*a* may again be of substantial thickness. Alternatively each member may be provided with a projection 20 on its inner face by which the member 5*a* is anchored in the mass of particulate material. If the structure extends above the surface of the water, the facing above the surface of the water may be made of the same panels as are used below the surface of the water or may be made of panels which are not adapted for use under water, for example as shown in FIG. 9.

It will be appreciated that the above proposals for use under water are equally applicable to a land construction and could indeed be used in a land construction.

Finally, it will be appreciated that where a structure is erected with a lateral surface and that surface is not provided with a facing to which the stabilising elements are connected, a facing may still be provided on that surface but that facing must be self sustaining or otherwise anchored to the structure.

What is claimed is:

1. A structure comprising a mass of particulate material and stabilizing members, said structure having at least one pair of opposite sides each member being elongated relative to its width with at least some of said members being integrally connected to each other and extending in zig-zag fashion in a substantially horizontal plane between opposite sides of the structure, the members being arranged in vertically spaced layers separated by layers of particulate material, said members being made of flexible material which is substantially unresilient, and means tensioning said members separately and independently of any tension exerted thereon by said particulate material.

2. A structure as claimed in claim 1, wherein the structure has at least two lateral surfaces and the members of a respective layer comprise at least two sets of members, each set of members extending from a lateral surface into the structure.

3. A structure as claimed in claim 1 wherein the integrally connected together members are provided by a single continuous length of flexible material.

4. A structure as claimed in claim 1, including a facing defining a lateral face for said structure, the members being connected to the facing and extending therefrom inwardly of the structure.

5. A structure as claimed in claim 4, wherein the members are connected to the facing by means of an element connected to the facing which extends through a loop formed between two integrally connected members.

6. A structure as claimed in claim 5, wherein the element is releasably connected to the facing.

7. A structure as claimed in claim 4, wherein the facing comprises a plurality of facing members and each facing member is connected to at least one stabilising member in each of two adjacent layers of stabilising members.

8. A structure as claimed in claim 4, wherein the facing comprises a plurality of facing members which are assembled together so as to permit limited relative vertical movement therebetween.

9. A structure as claimed in claim 1, wherein the stabilising members are made of a synthetic plastics material.

10. A structure as claimed in claim 1, wherein the particulate material is non-cohesive and has particles of not greater than 350 mm in diameter with not less than 75% smaller than 150 mm in diameter and less than 25% smaller than 75 microns.

11. A method of constructing a structure comprising a mass of particulate material and elongate stabilizing members, said structure having at least one pair of opposite sides comprising the steps of arranging in zig-zag fashion between a pair of opposite sides of the structure a plurality of elongated flexible substantially unresilient stabilizing members in a layer on a layer of particulate material, tensioning said stabilizing members and thereafter laying a second layer of particulate material over the layer of tensioned stabilizing members, and repeating the arranging and tensioning of successive layers of stabilizing members and laying over each of said layers a layer of particulate material until a structure of the required height is achieved, the tensioning of each layer of said stabilizing members being separate from any tensioning produced by said particulate material and while at least part of the succeeding layer of particulate material is being laid.

12. A method as claimed in claim 11, wherein the stabilising members of each layer are arranged in at least two sets, the members of each set extending between pairs of opposite sides of the structure.

13. A method as claimed in claim 11, wherein the or at least some of the members in each layer are integrally connected together and provided by a single continuous length of flexible material.

14. A method as claimed in claim 11 of constructing said structure with a lateral face, providing said face with a facing, and connecting the stabilizing members of each layer to said facing, the members extending from the facing inwardly of the structure.

15. A method as claimed in claim 14, wherein the facing comprises a plurality of facing members which are arranged in rows extending parallel to the layers of particulate material and stabilising members and the facing is built up simultaneously with the layers of particulate material and stabilising members.

16. A method as claimed in claim 14, wherein the stabilising members are connected to the facing by elements which are connected to the facing and extend through loops between adjacent integrally connected members.

17. A method as claimed in claim 11, wherein tension is applied by application of a pull to one end of each stabilising member.

18. A method as claimed in claim 11, wherein the stabilising members of a layer are integrally connected together so as to provide loops between adjacent ends of the stabilising members, the loops at one side of the structure are held relative to the structure and the loops at the other side of the structure are engaged by a tensioning member on which the pull is exerted.

19. A method as claimed in claim 11, wherein each layer of particulate material is compacted before the succeeding layer of stabilising members are laid thereon.

20. A method as claimed in any one of claims 11, 12, 13, 14–16, or 17–19 wherein a layer of sheet material extending substantially continuously across the structure is arranged between each layer of stabilising members and the succeeding layer of particulate material.

* * * * *